US005619765A

United States Patent [19]

Tokita et al.

[11] Patent Number: 5,619,765

[45] Date of Patent: Apr. 15, 1997

[54] DEVICE FOR REMOVING A FILM-LIKE IMAGE FORMING SUBSTANCE

[75] Inventors: Toshiaki Tokita, Zama; Akiko Konishi, Tokyo; Yasuo Miyoshi, Yokohama; Kakuji Murakami, Kamakura; Toshiaki Takahashi, Kawasaki, all of Japan

[73] Assignee: Ricoh Company, Ltd., Tokyo, Japan

[21] Appl. No.: 523,958

[22] Filed: Sep. 6, 1995

[30] Foreign Application Priority Data

Sep. 6, 1994 [JP] Japan ..... 6-238369

[51] Int. Cl.[6] ..... B08B 11/00; G03G 21/00

[52] U.S. Cl. ..... 15/3; 134/122 R; 399/123

[58] Field of Search ..... 15/1.51, 102, 103.5, 15/100, 97.1, 3; 355/307, 296, 297, 303; 156/230, 241, 247, 281; 134/122 R

[56] References Cited

U.S. PATENT DOCUMENTS

| | | | |
|---|---|---|---|
| 4,972,200 | 11/1990 | Arahara et al. | 355/296 |
| 4,999,679 | 3/1991 | Corbin et al. | 355/296 |
| 5,353,108 | 10/1994 | Tsukamoto | 355/296 |
| 5,400,123 | 3/1995 | Sato et al. | 15/102 |
| 5,474,617 | 12/1995 | Saito et al. | 355/307 |

FOREIGN PATENT DOCUMENTS

| | | |
|---|---|---|
| 297294 | 11/1989 | Japan . |
| 64473 | 2/1992 | Japan . |
| 64472 | 2/1992 | Japan . |
| 333088 | 11/1992 | Japan . |

*Primary Examiner*—Tony G. Soohoo

*Attorney, Agent, or Firm*—Oblon, Spivak, McClelland, Maier & Neustadt, P.C.

[57] ABSTRACT

In a device for recycling a recording medium by removing a film-like image forming substance from the medium, a separating member contacts one side of the medium carrying the substance. The separating member is durable because its surface contacting the medium is provided with a measure against deterioration. Anticorrosion means reduces the deterioration rate of the separating member.

24 Claims, 3 Drawing Sheets

DEVICE FOR REMOVING A FILM-LIKE IMAGE FORMING SUBSTANCE

BACKGROUND OF THE INVENTION

1. Field of the Invention

The present invention relates to a device for recycling a recording medium by removing a film-like image forming substance from the medium.

2. Discussion of the Background

In modern offices, various kinds of papers, including printer papers and copier papers, are used in a considerable amount, and most of them are simply discarded. This not only requires extra costs for disposal, but also deteriorates the regional environment due to the disposal. Moreover, excessive lumbering for the production of papers brings about global environmental disruption.

In light of this, it has been customary to recycle used papers by removing ink from the papers, immersing the papers in a liquid, and again making papers. A recent achievement in this respect is a paper which allows character images formed thereon to be removed by cleaning. This kind of paper can be recycled for a copying or printing purpose. Japanese Patent Laid-Open Publication No. 4-67043, for example, discloses a paper having a sheet-like image support whose sides, particularly one side, is treated to have a parting ability. The paper with a parting ability is marked to be distinguished from ordinary papers. However, this paper is a special paper and cannot be easily applied to a copier because of its poor image fixing ability. Japanese Patent Laid-Open Publication Nos. 1-101576 and 1-101577 each teach a method of removing a film-like image forming substance (toner) from an image support by effecting ultrasonic treatment in an organic solvent to which the substance is soluble. However, this kind of scheme is not feasible for ordinary offices and homes because organic solvents are apt to pollute the environment and are inflammable and toxic. Further, Japanese Patent Laid-Open Publication No. 1-297294 proposes a cleaning method practicable with an image support made of plastic, metal, paper having low infiltration, or ceramic. An image formed on such a support is heated with the intermediary of a meltable separating body and removed from the support thereby. However, this method is not practicable without a special paper having surfaces treated for parting.

On the other hand, Japanese Patent Laid-Open Publication No. 4-255916, equivalent U.S. Pat. No. 5,474,617, for example, teaches a device for removing a film-like image forming substance from a recording medium having a swelling layer, which swells with a water-containing image removal promoting liquid, at least in the vicinity of a surface where an image is to be formed. The device has applying means for applying the liquid to the recording medium on which an image is formed by the image forming substance, to thereby cause the swelling layer to swell more than the image forming substance. Separating means separates the substance from the medium by pressing its separating member against the medium to which the liquid has been applied, while heating the medium. As a result, the substance is transferred from the medium to the separating member. It has been reported that this kind of device is capable of removing only the substance from the medium without noticeably damaging the medium or paper. It has also been reported that the separation characteristic, particularly separation ratio available in the event of repeated use, is noticeably dependent on the material of the separating member or the conditions surrounding the device. It is to be noted that the separation ratio refers to the ratio of the area of the substance separated from the medium to the total area of the image; the ratio is 100% when the entire substance is separated or 0% when the substance is not separated at all. The above occurrence results from, among others, the fact that the surface of the separating member contacting the medium deteriorates at a rate which is greatly dependent on the material of the separating member.

SUMMARY OF THE INVENTION

It is, therefore, an object of the present invention to provide a film-like image forming substance removing device which is durable to heat and pressure in the event of image separation, stable against an image removal promoting liquid, and sparing degenerative on the surface, and promotes desirable separation.

In accordance with the present invention, in a device for removing a film-like image forming substance from a recording medium having a swelling layer, which swells with a water-containing image removal promoting liquid, at least in the vicinity of the surface where an image is to be formed, an applying unit applies the image removal promoting liquid to the recording medium on which an image is formed by the image forming substance, to thereby cause the swelling layer to swell more than the image forming substance. A separating unit has a separating member for separating the image forming substance from the recording medium by being pressed against the recording medium to which the image removal promoting liquid has been applied. At least the surface of the separating member that contacts the recording medium is formed of a metallic material.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

A device of the present invention and for removing a film-like image forming substance will be described with reference to the accompanying drawings. It is to be noted that the word "film-like" refers not only to a condition wherein the entire image forms a single film, but also to a condition wherein the image forming substance is not infiltrated deep into a recording medium, and a condition wherein the substance is not adsorbed by the medium almost at a molecule level. Such adsorption usually occurs with water ink containing dyes.

Figure 1:
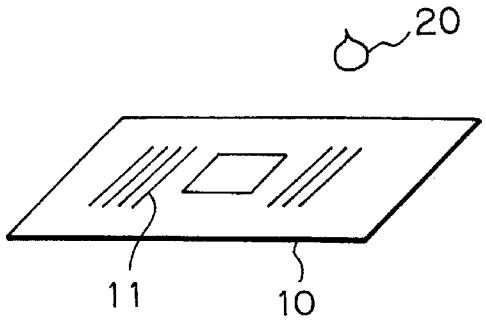
FIG. 1 is a perspective view schematically showing a recording medium and an image removal promoting liquid with which the present invention is practicable.

FIG. 1 shows a printer paper, copier paper or similar recording medium 10 on which an image is formed by a film-like image forming substance 11. First, the device of the present invention causes a liquid 20 for promoting the removal of the image to infiltrate into the medium 10. As a result, the adhesion between the surface of the medium 10 and the substance 11 stably deposited thereon is reduced.

The liquid 20 may be implemented by, for example, water, an aqueous solution containing a surfactant, or an aqueous solution containing a surfactant and water-soluble high molecule. If desired, use may be made of an additive, e.g., pH adjuster, chelate agent for sealing heavy metal ions, antiseptic, antifungal substance, rust inhibitor, or bleach. When the liquid 20 is implemented by an aqueous solution containing a surfactant, the agent should be added in an amount of 0.01 wt % to 20 wt %, preferably 0.1 wt % to 5 wt %. It is to be noted that liquids having different compositions and different densities may be applied several times, in which case the above particular range is not limitative.

The surfactant to be added should preferably be of the kind capable of being stably dispersed or dissolved in water. Examples of such a surfactant are as follows.

Anionic surface active agents include soap, N-acylamino acid salt, alkyl ether acetate, acylated peptide or similar carboxylate, alkyl sulfonate, alkyl benzene sufonate, alkyl naphthalene sulphonate, sulfosuccinate, α-olefine sulfonate, N-acyl sulfonate or similar sulfonate, sulfated oil, alkyl sulfate, alkyl ether sulfate, alkyl amide sulfate or similar sulfuric ester, and alkyl phosphate, alkyl ether phosphate, alkyl aryl phosphate or similar phosphoric ester salts.

Cationic surfactants include aliphatic amine salt, alkyl quaternary ammonium salt, aromatic quaternary ammonium salt, and heterocyclic quaternary ammonium salt.

Ampholytic surfactants include carboxy betaine, sulfobetaine and other betaines, amino carboxylate, and imidazoline derivative.

Nonionic surfactants include polyoxyethylene alkyl and anyl ether, plyoxyethylene styrol ether, polyoxyethylene lanoline derivative, ethylene oxide derivative of alkyl aryl formaldehyde condensation product, polyoxyethylene polyoxypropyrene block copolymer, polyoxyethylene polyoxypropyrene alkyl ether or similar ether, polyoxyethylene glycerol fatty acid ester, polyoxyethylene sorbitane fatty acid ester, polyoxyethylene sorbitol fatty acid ester or similar ether ester, polyethylene glycol fatty acid ester, fatty acid monoglycede, polyglycerin fatty acid ester, sorbitane fatty acid ester, propylene glycol fatty acid ester, sucrose fatty acid ester or similar ester, fatty acid alkanol amide, polyoxyethylene fatty acid amide, polyoxyethylene alkyl amin, and alkyl amine oxide or similar nitrogen-containing agent.

Fluorin-contained surfactants include fluoroalkyl carboxylate, fluoroalkyl sulfonate and other anion agents, fluoroalkyl-introduced betaine and other ampholytic surfactants, nonionic surfactants, and cationic surfactants.

Silicone-based surfactants are also usable, if desired.

The above surfactants may be used alone or in combination. Further, a water-soluble high molecule may be added to the agent together with the surfactant in order to enhance the removal of the film-like image forming substance or to improve the recycling condition.

The water-soluble high molecule may be selected from a group of natural high molecules, a group of semisynthetic high molecules, or a group of purely sythetic high molecules. The natural high molecules include Arabian gum, tragacanth gum, karaya gum, locust bean gum, arabinogalactone, pectin, and other plant high molecules; alginic acid, agar, funori, and other seaweed high molecules; gelatin, casein, albumin, collagen, and other animal high molecules; and xanthene gum, dextran and other microorganism high molecules. The semisynthetic high molecules include methyl cellulose, ethyl cellulose, hydroxyethyl cellulose, hydroxypropyl cellulose, carboxymethyl cellulose, and other fibrous high molecules; methyl starch, carboxymethyl starch (CMS), dialdehyde starch, starch sodium glycolate, starch sodium ester phosphate, and other soluble starch high molecules; and sodium alginate, propylene glycol ester alginate, and other seaweed high molecules. The purely synthetic high molecules include polyvinyl alcohol, polyvinyl pyrrolidone, polyvinyl methyl ether, and other vinyl-based high molecules, non-bridged polyacryl amide, polyacrylic acid and its alkaline metal, water-soluble styrene acryl resin, and other acrylic resins; water-soluble styrene maleinic acid resin, water-soluble vinylnaphthalene acrylic resin, water-soluble vinylnaphthalene maleinic acid resin, polyvinyl pyrrolidone, polyvinyl alcohol, alkali metal salt of a β-naphthalene sulphonic acid formalin condensation product, a high molecular compound having the salt of an amino group or similar cationic functional group at its side chain, ceramic or similar natural high molecular compound, etc.

It is desirable that the above water-soluble high molecule be added in an amount of 0.1 wt % to 20 wt %, more preferably 0.1 wt % to 10 wt %, although it depends on the method of feeding the liquid 20.

In accordance with the present invention, by causing the medium 10 to hold a water-soluble high molecule while containing water and water and surface active agent, it is possible to form a separating body for separating the substance 11. Specifically, the water-soluble high molecule can indirectly contact the film-like image existing in the cellulose fibers which the separating member cannot contact. The resulting adhesion allows the film-like image to be separated without damaging the medium 10.

The pH adjuster, which may be added to the liquid, is open to choice so long as it is capable of controlling pH to above 7 without adversely effecting the liquid. For example, use may be made of diethanolamin, triethanolamin or similar amine, lithium hydride, sodium hydride, potasium hydride or similar hydride of alkali metal, ammonium hydride, lithium carbonate, sodium carbonate, or similar carbonate of alkali metal.

The chelating agent, which may be added as a heavy metal ion sealing agent, may be implemented by sodium ethylenediamine tetraacetate, sodium nitrirotriacetate, sodium hydroxyethylethylenediamine triacetate, sodium diethylenetriamin pentaacetate, and sodium uramil diacetate. Rust inhibitors include acid sulfite, sodium thiosulfate, ammon thiosulfate, ammon thiodiglycolic acid, diisopropyl ammonium nitrite, pentaerythritol tetranitrate, and dicycloyhexyl ammonium nitride. Further, antiseptics and antifungal substances include sodium dehydroacetate, sodium sorbic acid, sodium 2-pyridinethiol-1-oxide, sodium benzoate, and sodium pentachlorophenol.

A bleach may be added to the liquid in order to enhance the whiteness of the recycled medium 10. Examples of the bleach are hydrogen peroxide, sodium peroxide, soidum percarbonate, and sodium hypochloride. If desired, fluorescent dyes, bluing dyes, ferment or the like may also be added. The angle at which the liquid contacts the substance 11 should preferably be less than 90 degrees, more preferably less than 50 degrees. The surface tension of the liquid should preferably be less than 70 mN/m (dyne/cm), more preferably less than 50 mN/m. Further, assuming that the time t for which the water-containing liquid and medium 10 contact is 0.4 second, the infiltration rate of the liquid in the medium 10 should preferably be higher than 10 ml/m$^2$, more preferably 12 ml/m$^2$.

Figure 2:
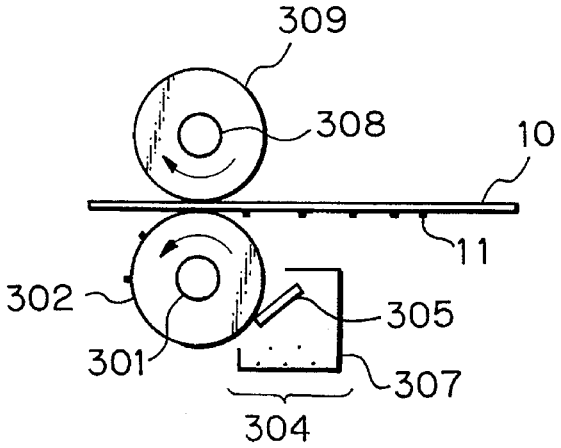
FIG. 2 is a section showing a part of an image forming substance removing device of the present invention and for removing a film-like image forming substance from the medium.

As shown in FIG. 2, the device of the present invention has a separating member for exerting adhesion between it and the substance 11 which is greater than adhesion acting between the substance 11 and the medium 10. The separating member is held in contact with the medium 10 under the application of pressure or pressure and heat. As a result, the substance 11 is transferred from the medium 10 to a separation roller 302. The separating member may be implemented by the roller 302 itself, depending on the material of the roller 302. Alternatively, the surface of the roller 302 may be treated for the separation of the substance 11 or may even be coated or otherwise covered with a different material. The heat applied to the medium 10 softens the substance 11 and thereby promotes the separation of the substance 11 from the fibers of the medium 10. For this purpose, use is made of a heater. As for the pressure, the medium 10 is passed through a nip between the roller 302 and a press roller 309. A heater 308 is disposed in the press roller 309 as auxiliary heating means.

Preferably, the medium 10 should be heated to a temperature higher than the softening point of the substance 11, but lower than the temperature which melts the substance 11 between the medium 10 and the roller 302. Should the substance melt, it would be difficult to transfer the entire substance 11 from the medium 10 to the roller 302 without splitting into two. In addition, excessive heat is likely to dry the medium 10 excessively when the medium is in transport in contact with the roller 302. This increases the adhesion of the substance 11 to the medium 10, compared to the condition wherein the medium 10 is wet. As a result, the medium 10 is apt to firmly adhere to the roller 302 via the medium 11. In light of this, the medium 10 should preferably be heated to a degree which allows some water to remain in the medium 10 and prevents the substance 11 from again depositing on the medium.

The separating member on the surface of the roller 302 should preferably be made of a material durable to heat and pressure to act when the member contacts the above separating means, stable against the liquid 20, sparingly degenerative, and enhancing the separation, as will be described later specifically.

The roller 302 may be replaced with a belt. When the belt or separation belt is made of the previously mentioned resin, it should preferably be implemented as at least two layers, i.e., a support layer and a surface layer. That is, the separation belt should preferably be made up of a support or belt body, and a surface layer formed thereon and implemented by the above material.

Figure 3:
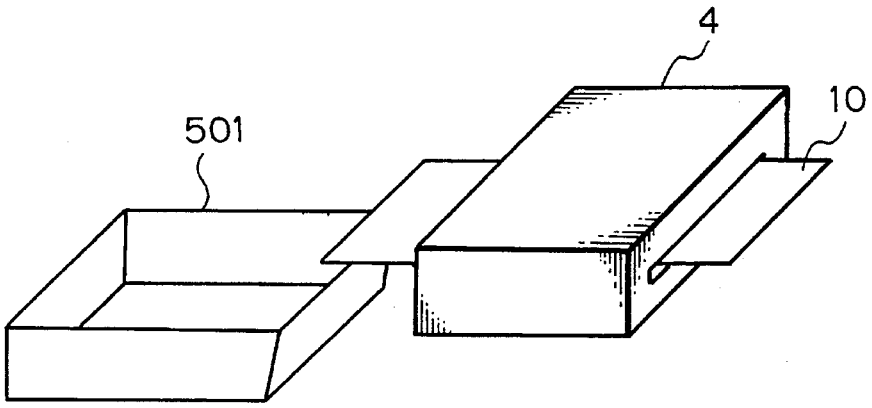
FIG. 3 is a perspective view of a drier unit and a tray unit included in the device of the present invention.

Impurities transferred to the separating member of the roller 302 and including the substance 11, paper dust and smears are removed from the roller 302 by a cleaning unit 304 which will be described. As shown in FIG. 3, after the removal of the substance 11, the medium 10 is dried by a drier unit 4 and then driven out to a tray unit 501. The cleaning unit 304 has a cleaning member 305 and a box 307.

The cleaning unit 304 may clean the separating member every time the roller 302 separates the substance 11 or every time the separation is repeated an adequate number of times. Preferably, the cleaning member 305 should be capable of exerting a shearing force on the impurities deposited on the separating member, and scraping them off. Specifically, the cleaning member 305 may be implemented as a roll-like brush having an elongate base wider than the medium 10 and fur implanted in the base, or a blade-like member. As for the cleaning characteristic, a brush made of metal or soft plastic and a blade made of metal, soft plastic or soft rubber was desirable, as will be described later in detail. The cleaning member 305 may be used alone or may be combined with other cleaning members.

There may be used a cleaning system not relying on the above shearing force. This kind of cleaning system has a cleaning roller contacting the roller 302 and exerting adhesion between it and the substance which is greater than the adhesion between the substance 11 and the separating member. The medium 11 transferred from the medium 10 to the separating member is further transferred to the cleaning roller. The alternative system noticeably reduces damage to the surface of the separating member attributable to cleaning, compared to the cleaning system using a shearing force.

When the substance 11 is transferred from the medium 10 to the separating member, the surface of the separating member should be made of a material durable to heat and pressure, stable against the liquid 20, sparingly degenerative, and enhancing the separation. Further, experiments have shown that the material suitable for the separating member depends on the kind and configuration of the separating means and those of the cleaning means. For example, assuming the previously mentioned roller-like separating member and belt-like separating member, durability to bends and pulls are not critical for the former, but they are critical for the latter. Also, the characteristic, e.g., wear resistance, required of the separating member depends on the material and structure of the cleaning member 305, i.e., which of the roll-like brush and blade is used and which part of the roll-like brush is used.

Further, the liquid 20 infiltrated into the medium 10 and contacting the separating member often degenerates the surface of the separating member. Presumably, the degeneration mechanism of the separating member differs from the case wherein the surface of the member is made of a material whose major component is a synthetic resin to the case wherein it is made of metal. As for metal, the degeneration is considered to result from oxidation, among others. As for a material whose major component is a synthetic resin, it is likely that the liquid 20 disturbs or cancels carbon coupling in molecules and varies the molecular structure itself. At the same time, as for the material whose major component is a synthetic resin, it is likely that a part of the components of the liquid 20 penetrates into the separating member, and its characteristic is reflected by the surface characteristic of the member. In any case, the degeneration of the surface of the separating member sequentially changes the separation characteristic and should, therefore, be taken into consideration in the event of selection of the separating member.

A series of experiments and researches have shown that when the surface of the separating member contacting the medium 10 is formed of metal, it is durable to heat and pressure, stable against the liquid 20, sparingly degenerative, and enhances the separation. This kind of surface achieved desirable corrosion resistance when formed of metal or alloy containing at least one of Fe, Co, Ni, Al, Cr, Au, Ag and Cu, preferably Ni steel, stainless steel, Fe-Ni alloy, Cl-Al alloy, Monel metal, Inconel or duralumin. The desirable corrosion resistance was also attained when the surface was made up of an alloy containing at least one of Fe, Co, Ni, Al, Cr and Cu, and a metal oxide film formed on the alloy. To form the oxide film, the surface of the separating member made of, for example, metal is subjected to anodic oxidation, pyrolysis, or similar treatment. Because the oxide film promotes the use of inexpensive metal for the separating member, it is desirable from the cost standpoint. Further, a film of precious metal or the like, which is expensive when used alone, may be formed on the roller- or belt-like separating member. This successfully reduces the cost while making the most of the characteristic of the metal. To form this kind of film, use may be made of plating, vacuum plating, sputtering, or similar technology.

The separating member, having its surface formed of metal or metal oxide, prevents the separation ratio from being noticeably reduced despite its repeated use, as stated above. To further enhance this advantage, there may be provided means for maintaining the potential of the separating member lower than the anticorrosion potential of the same. This is because, ideally, metal oxidation does not occur at potentials lower than the anticorrosion potential. The anticorrosion potential can be controlled if, for example, a DC power source is used and has its negative electrode connected to the separating member and has its positive electrode connected to high Si iron, black lead, lead and silver alloy, or a similar material capable of forming an insoluble anode. It is preferable to provide such an arrangement with an electrometer for constantly sensing the potential of the separating member. The DC power source is omissible if metal (sacrifice metal) more base than the metal constituting the separating member is connected to the member by a conductor. This kind of metal allows a cathode voltage to naturally flow into the separating member. In this case, it is necessary to replace the sacrifice metal periodically because it corrodes. In addition, consideration should be given to the contamination of the device due to the corrosion of the sacrifice metal.

Preferred embodiments of the device in accordance with present invention will be described in detail.

1st EMBODIMENT

Figure 4:
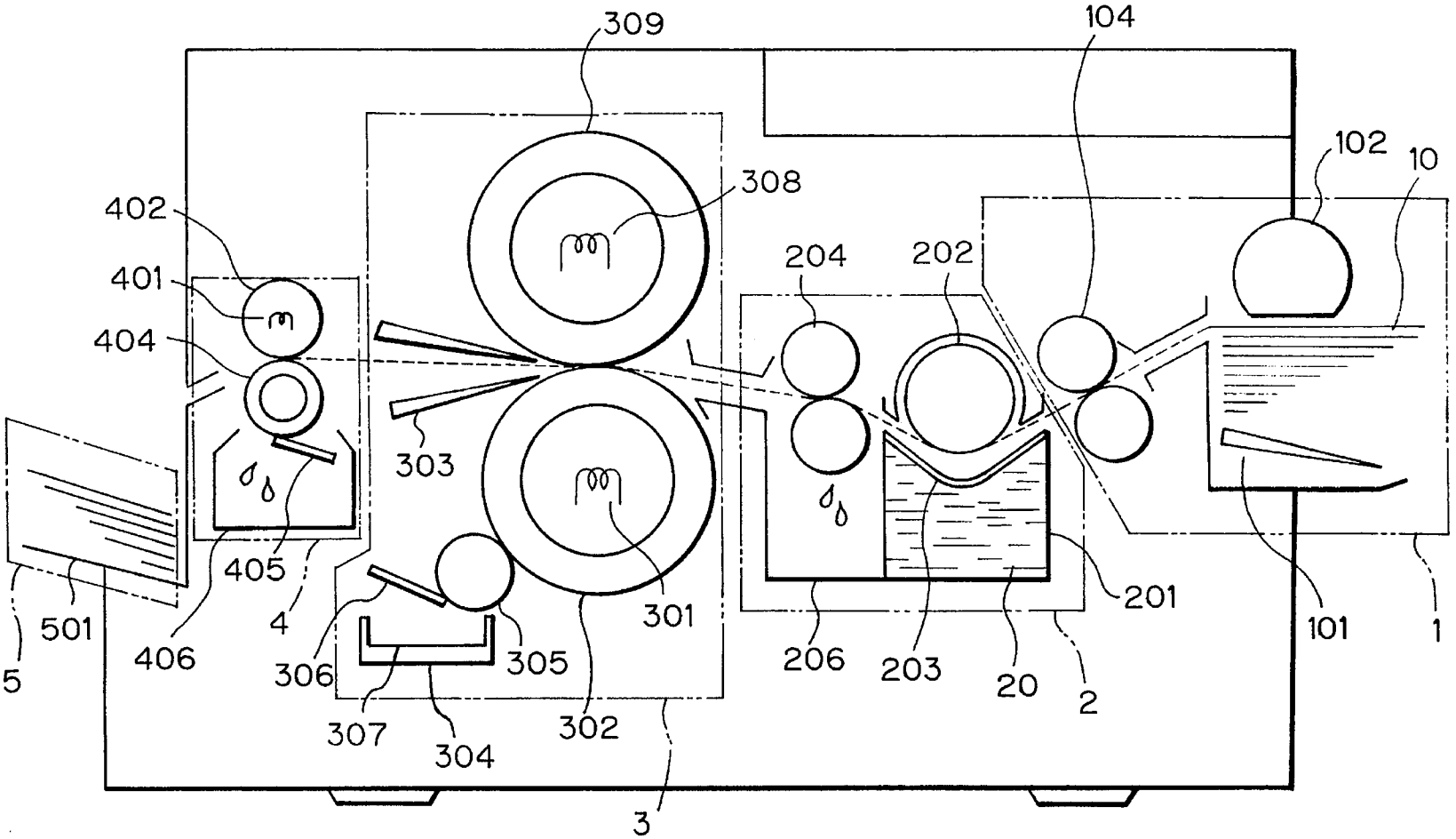
FIG. 4 is a section showing the device of the present invention specifically.

Referring to FIG. 4, a first embodiment is made up of a paper teed unit 1, a liquid feed unit 2, an image removal unit 3, a drier unit 4, and a tray unit 5. The device is assumed to recycle media (transfer papers) 10 carrying images formed by an electrophotographic copier or the like.

The paper feed unit 1 has a bottom plate 101 on which papers 10 are stacked face down. A pick-up roller 102 feeds the top paper 10 first. At this instant, a separating mechanism, not shown, separates the top paper 10 from the underlying papers 10. The paper 10 is once brought to a stop by a registration roller pair 104 for purposes well known in the electrophotographic copiers art.

The liquid feed unit 2 has a vessel filled with a predetermined amount of liquid 20. A roller 202 guides the paper 10, coming out of the registration roller pair 104, into the liquid 20 while contacting one side (top as viewed in FIG. 4) of the paper 10. A drive section, not shown, drives the roller 202. A guide plate 203 guides the other side (bottom as viewed in FIG. 4) into the liquid 20. A squeeze roller pair 204 plays the role of conveying means at the same time. In this configuration, the paper 10 is guided into the liquid 20 by the roller 202 and guide plate 203, immersed in the liquid 20, squeezed by the roller pair 204 to remove the excess part of the liquid 20, and then conveyed to the image removal unit 3.

The image removal unit 3 has a separation roller 302 in which a heat lamp 301 is disposed as means for softening the substance 11. A press roller 309 presses the medium 10 against the previously stated separating member. A heat lamp 308 is disposed in the press roller 309 to serve as auxiliary heating means. A separator 303 is held in contact with a part of the surface of the separation roller 302 which adjoins the nip between the rollers 302 and 309 at the paper outlet side. A cleaning device 304 cleans the surfaces of the separation roller 302 and is driven by a drive section, not shown. The lamps 301 and 308 heat and thereby soften an image forming substance firmly adhered to the opposite sides of the paper 10. This successfully promotes the separation of the substance from the fibers of the paper 10. The cleaning device 304 is made up of a cleaning roller 305, a scraper blade 306, and a box 307. The cleaning roller 305 removes impurities, including the substance 11, from the surface of the separation roller 302. The scraper blade 306 scrapes off the impurities from the cleaning roller 305. The impurities removed by the blade 306 are collected in the box 307.

The drier unit 4 has an upper roller accommodating a heat lamp 401, and a lower roller 404 pressed against the bottom of the upper roller 402. The lower roller 404 has a surface layer which absorbs the liquid. A blade 405 is held in contact with the lower roller 404 in order to squeeze the liquid out of the surface layer. The tray unit 5 has a tray 501 for receiving the paper 10 coming out of the drier unit 4.

Also included in the device are sensor means for determining whether or not the papers 10 are present on the plate 101, sensor means for detecting the simultaneous feed of a plurality of papers 10 from the paper feed unit 1, sensor means for sensing the amount of liquid remaining in the vessel 201, means for automatically replenishing the liquid into the vessel 201, sensor means for detecting a jam which may occur in the device, means for controlling the turn-on of the lamps, and sensor means responsive to the full state of the box 307, although not shown specifically.

Separating members were prepared by use of materials listed in Table 1 below, and their separation characteristics were estimated.

TABLE 1

| Material | Initial Separation Ratio (%) | Separation Ratio After Operation (%) |
|---|---|---|
| Fe | 100 | 100 |
| Cu | 100 | 100 |
| Al | 100 | 100 |
| Ni | 100 | 100 |
| Au | 100 | 100 |
| Ag | 100 | 100 |
| stainless steel (SUS 304) | 100 | 100 |
| Fe—Ni alloy | 100 | 100 |
| Co—Al alloy | 100 | 100 |
| Monel | 100 | 100 |
| Inconel | 100 | 100 |
| duralmin | 100 | 100 |
| polypropyrene | 100 | 60 |

In this embodiment, the cleaning roller 305 was formed of polycarbonate. The paper 10 was conveyed at a speed of 30 mm/sec. The optimal surface temperature of the separation roller and that of the press roller were dependent on the material constituting the separating member. However, a desirable separation characteristic was achieved when the former was 90° C. to 160° C. and the latter was the same as or tens of degrees lower than the former. The papers 10 and substance 11 were implemented by commercially available copy papers and toner, respectively. The papers 10 carried images formed by a dry process copier as samples. Initially, a separation ratio of 100% was attained with each of the materials listed in Table 1 and by adequately setting the surface temperatures of the separation roller and press roller.

In the above conditions, the device was continuously operated while a separation test was conducted at preselected intervals. With the separating member formed of metal, the separation ratio remained to be 100% even after 10 hours of operation. By contrast, the separating member formed of a synthetic resin (polypropyrene) began to reduce the separation ratio in 8 hours. Presumably, this is mainly because the structures of the constituent parts varied due to heat and pressure. Table 1 shows separation ratios found in 10 hours. As Table 1 indicates, metals are advantageous over synthetic resins in respect of the durability of the separating member to the continuous operation of the device.

2nd EMBODIMENT

The metals included in the materials of Table 1 were selected and immersed in an image removal promoting liquid over a long period of time. Subsequently, such materials were each mounted to the device shown in FIG. 4 in order to determine the separation characteristic, i.e., the stability of the separating member against the liquid. The above immersion lasted one month at room temperature. Table 2 shown below lists the results of the tests.

TABLE 2

| Material | Initial Separation Ratio (%) | Separation Ratio After Immersion (%) |
|---|---|---|
| Fe | 100 | 30 |
| Cu | 100 | 60 |
| Al | 100 | 85 |
| Ni | 100 | 100 |
| Au | 100 | 100 |
| Ag | 100 | 100 |
| stainless steel (SUS 304) | 100 | 100 |
| Fe—Ni alloy | 100 | 100 |
| Co—Al alloy | 100 | 100 |
| Monel | 100 | 100 |
| Inconel | 100 | 100 |
| duralmin | 100 | 100 |

As shown in Table 2, with stainless steel, Fe-Ni alloy, Co-Al alloy, Monel metal, Inconel, and duralumin, the characteristic deteriorated little, i.e., the stability against the liquid was desirable. However, as for Fe and Cu, the surface varied in color due to oxidation, and the oxides were transferred to the papers. It will be seen from the above that the separating members formed of stainless steel, Fe-Ni alloy, Co-Al alloy, Monel metal, Inconel and duralumin are particularly stable against the liquid.

3rd EMBODIMENT

The separation roller 302 was formed of Al, as shown in Tables 1 and 2, and subjected to anodic oxidation for forming an oxide film thereon. For the film formation, there were sequentially executed base (Al) grinding, fat removal, rinsing, electrolytic polishing, anodic oxidation, and sealing. For electrolysis, a liquid of 5% to 10% chromic acid was used. The temperature was maintained at 40° C., and the voltage was so controlled as to maintain a current density of 0.3 A/dm$^2$ to 0.3 A/dm$^2$. The sealing was implemented by vapor processing. The resulting oxide film was measured to be about 1 μm thick. When a separation test was conducted with the roller with the Al oxide film, the roller was comparable in initial characteristic with a roller lacking the Al oxide film. The Al roller was subjected to the immersion test described in the second embodiment. After one month of immersion, the separation ratio remained to be 100%, which is higher than 85% particular to the Al roller without the oxide film. The test, therefore, showed that the oxide film enhances the stability of the separating member against the liquid.

4th EMBODIMENT

Three separation rollers 302 formed of Fe, as shown in Tables 1 and 2, were prepared and respectively provided with a Cr film, an Ni-Cr film, and a Pt film by plating. For the plating, there were sequentially executed base (Fe) grinding, alikaline fat removal, electrolytic fat removal, acid rinsing, neutralization, and electric plating. The electric plating was controlled in such a manner as to form a 0.5 μm to 1 μm thick film. Separation tests proved that the above three rollers are comparable in separation ratio with an Fe roller without a film. The three rollers were subjected to the immersion test described in the second embodiment. The immersion test showed that all the three rollers maintain a separation ratio of 100%, i.e., the stability against the liquid is enhanced by the metal film or metal alloy film.

5th EMBODIMENT

Figure 5:
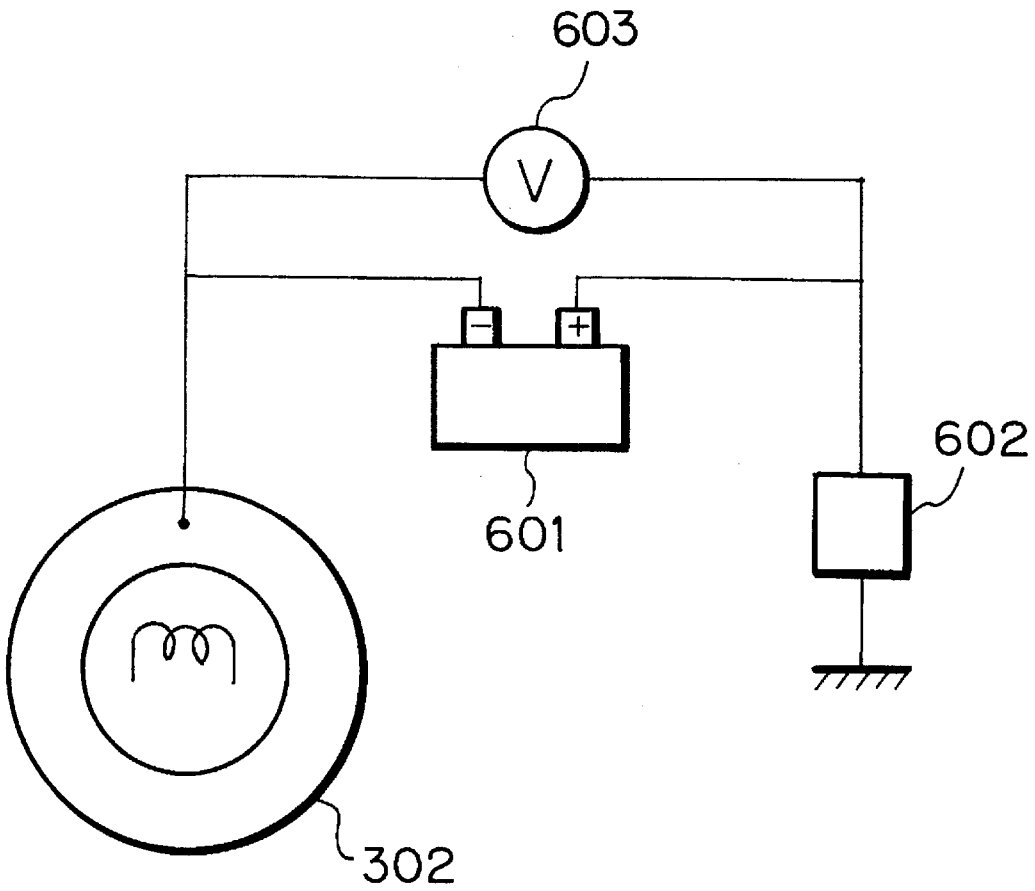
FIG. 5 shows a specific arrangement of means for controlling the anticorrosion potential of a separating member included in the device of the present invention.

The potential of the separation roller 302 formed of Fe, as shown in Tables 1 and 2, was controlled, as follows. As shown in FIG. 5, a DC power source 601 is disposed in the device and has its positive electrode connected to high Si iron 602 also disposed in the device. The negative electrode of the power source 601 is connected to the separating member. The high Si iron 602 may be replaced with black lead, lead-silver alloy or a similar material capable of forming an insoluble anode, if desired. The potential of the high Si iron 602 was preselected to be equal to the reference potential (ground) of the device while the potential of the separating member was preselected to be −0.85 V. This particular potential of the separating member is an anticorrosion potential determined by experience with Fe. The device was left in the above condition for two weeks. Then, a separation ratio of 100% was achieved as a result of a transfer test. The surface of the roller 302 changed little from its initial condition. For comparison, the potential of the separating member having the above configuration was made equal to the reference potential, and the device was left in such a condition for two weeks. The resulting separation ratio was lower than 50%, and papers were contaminated presumably by the corrosion of the roller 302. Moreover, the surface of the separating member gathered rust. Consequently, it was found that by maintaining the potential of the separating member lower than the anticorrosion potential, it is possible to reduce metal oxidation and thereby enhance the stability against the liquid. In FIG. 5, the reference numeral 603 designates an electrometer.

In summary, it will be seen that the present invention provides a device for removing a film-like image forming substance and having various unprecedented advantages, as enumerated below.

(1) At least the surface of a separating member that contacts a recording medium is formed of a metallic element. Hence, the separating member is highly durable to heat and pressure during the course of image separation, stable against a liquid for promoting the removal of an image, sparingly degenerative, and promotes desirable separation.

(2) At least the above surface of the separating member is formed of an anticorrosive metallic element and/or alloy. This kind of separating member has sufficient corrosion resistance in addition to the above advantage (1).

(3) At least the above surface of the separating member is formed of an alloy. Use is made of a particular alloy having high corrosion resistance, thereby further enhancing corrosion resistance.

(4) The metallic element and/or alloy constituting at least the above surface of the separating member is implemented by the oxide of the element and/or alloy. This also enhances the corrosion resistance of the separating member.

(5) The potential of the separating member is preselected to be lower than its electrode potential at equilibrium. As a result, metal oxidation is reduced, and stability against the liquid is improved.

(6) The electrode potential at equilibrium of the separating member can be controlled with ease.

Various modifications will become possible for those skilled in the art after receiving the teachings of the present disclosure without departing from the scope thereof.

What is claimed is:

1. A device for removing a film-like image forming substance from a recording medium having a swelling layer, which swells with a water-containing image removal promoting liquid, at least in the vicinity of a surface where an image is to be formed, said device comprising:

applying means for applying said image removal promoting liquid to the recording medium on which an image is formed by the image forming substance, to thereby cause the swelling layer to swell more than the image forming substance;

separating means comprising a separating member for separating the image forming substance from the recording medium by being pressed against said recording medium to which said image removal promoting liquid has been applied;

at least a surface of said separating member that contacts the recording medium being formed of a metallic material; and electric potential control means for maintaining an electric potential of said separating member lower than an anticorrosion potential of said metallic material.

2. A device as claimed in claim 1, wherein said separating means heats the recording medium when said separating member is pressed against said recording medium.

3. A device as claimed in claim 1, wherein said separating member exerts an adhesion between said separating member and the image forming substance and greater than an adhesion acting between said image forming substance and the recording medium.

4. A device as claimed in claim 1, wherein said metallic material comprises at least one metallic element selected from a group consisting of Fe, Co, Ni, Al, Cr, Au, Ag, Cu, and or an alloy containing said at least one metallic element.

5. A device as claimed in claim 4, wherein said metallic material forms a film on said surface of said separating member.

6. A device as claimed in claim 5, wherein said film comprises a film of Ag, Au formed by a procedure selected from a group consisting of plating, vacuum plating, and sputtering.

7. A device as claimed in claim 6, wherein said film is formed on said separating member as one of a belt and a roller.

8. A device as claimed in claim 4, wherein said metallic material comprises at least one alloy selected from a group consisting of stainless steel, Fe-Ni alloy, Co-Al alloy, Monel metal, Inconel, and duralumin.

9. A device as claimed in claim 4, wherein said metallic material comprises an oxide.

10. A device as claimed in claim 9, wherein said oxide is formed by a procedure selected from a group consisting of anodic oxidation and pyrolysis.

11. A device as claimed in claim 1, wherein said electric potential control means comprises a DC power source connected to said separating member at a negative electrode thereof, and an insoluble anode connected to a positive electrode of said DC power source.

12. A device as claimed in claim 11, wherein said insoluble anode is formed of one of high Si iron, black lead, and lead-silver alloy.

13. A device for removing a film-like image forming substance from a recording medium having a swelling layer, which swells with a water-containing image removal promoting liquid, at least in the vicinity of a surface where an image is to be formed, said device comprising:

applying means for applying said image removal promoting liquid to the recording medium on which an image is formed by the image forming substance, to thereby cause the swelling layer to swell more than the image forming substance; and separating means comprising a separating member for separating the image forming substance from the recording medium by being pressed against said recording medium to which said image removal promoting liquid has been applied;

at least a surface of said separating member that contacts the recording medium being formed of a metallic material, wherein said metallic material comprises at least one metallic element selected from a group consisting of Fe, Co, Ni, Al, Cr, Au, Ag, Cu, and an alloy containing said at least one metallic element.

14. A device as claimed in claim 13, wherein said separating means heats the recording medium when said separating member is pressed against said recording medium.

15. A device as claimed in claim 13, wherein said separating member exerts an adhesion between said separating member and the image forming substance and the recording medium.

16. A device as claimed in claim 13, wherein said metallic material forms a film on said surface of said separating member.

17. A device as claimed in claim 16, wherein said film comprises a film of Ag, Au formed by a procedure selected from a group consisting of plating, vacuum plating, and sputtering.

18. A device as claimed in claim 17, wherein said film is formed on said separating member as one of a belt and a roller.

19. A device as claimed in claim 13, wherein said metallic material comprises at least one alloy selected from a group consisting of stainless steel, Fe-Ni alloy, Co-Al alloy, Monel metal, Inconel, and duralumin.

20. A device as claimed in claim 13, wherein said metallic material comprises an oxide.

21. A device as claimed in claim 20, wherein said oxide is formed by a procedure selected from a group consisting of anodic oxidation and pyrolysis.

22. A device as claimed in claim 13, further comprising electric potential control means for maintaining an electric potential of said separating member lower than an anticorrosion potential of said metallic material.

23. A device as claimed in claim 22, wherein said electric potential control means comprises a DC power source connected to said separating member at a negative electrode thereof, and an insoluble anode connected to a positive electrode of said DC power source.

24. A device as claimed in claim 23, wherein said insoluble anode is formed of one of high Si iron, black lead, and lead-silver alloy.

* * * * *